US006584966B1

(12) United States Patent
Summers et al.

(10) Patent No.: US 6,584,966 B1
(45) Date of Patent: Jul. 1, 2003

(54) ADJUSTABLE BACK TENSION ROPE RELEASE

(75) Inventors: Gregory E. Summers, 105 Overlink Ct., Lynchburg, VA (US) 24503; Marc T. Rentz, Madison Heights, VA (US); Randy Summers, Madison Heights, VA (US)

(73) Assignee: Gregory E. Summers, Lynchburg, VA (US)

( * ) Notice: Subject to any disclaimer, the term of this patent is extended or adjusted under 35 U.S.C. 154(b) by 0 days.

(21) Appl. No.: 09/925,023

(22) Filed: Aug. 9, 2001

(51) Int. Cl.[7] ..... F41B 5/18
(52) U.S. Cl. ..... 124/35.2
(58) Field of Search ..... 124/35.2

(56) References Cited

U.S. PATENT DOCUMENTS 3,853,111 A * 12/1974 Stanislawski et al. ..... 124/35.2
3,965,884 A 6/1976 Killian
4,877,009 A * 10/1989 Becker ..... 124/35.2
5,694,915 A 12/1997 Summers

OTHER PUBLICATIONS

Zenith Archery Products, "The Comfort Release," 2000, Internet, Revised Apr. 1, 2001.

Carter Release Aids, ReleaseAid.com, Internet, 1999.

Stanislawski Archery Prod, New Releases for 1997.

Stanislawski Archery Products Brochure, 1974 Desert Inn Classic.

Bernie's Can't Punch "Back Tension" Wrist Strap Release advertisement, 1998.

* cited by examiner

*Primary Examiner*—John A. Ricci
(74) *Attorney, Agent, or Firm*—Nixon & Vanderhye P.C.

(57) ABSTRACT

A triggerless back tension release for use with a bow string includes a handle portion including at least two finger grooves with a post extending substantially perpendicularly away from the handle portion; a two-link release head assembly secured to a free end of the post remote from the handle portion, the two-link release head including an intermediate link pivotably mounted on said post and a forward link pivotably mounted to said intermediate link; a rope loop having two free ends secured to the forward link; and a sear pivotably secured to the forward link, the sear having a hook adapted to receive the rope loop. The free ends of the rope loop are secured to the forward link at a location closely adjacent the hook and forward of the pivot axis, such that, when the rope loop is wrapped about a bow string and slipped over the hook, a gap between doubled-back strands of the rope between the bow string and the release head remains substantially constant or increases in a direction toward the bow string.

32 Claims, 11 Drawing Sheets

ADJUSTABLE BACK TENSION ROPE RELEASE

This invention relates to a bow string release and, more specifically, to a triggerless back-tension type release.

BACKGROUND OF THE INVENTION

Various release devices are utilized in archery to assist the archer in pulling a bow string to a fully drawn position and then releasing the bow string to fire an arrow. Many of these devices include mechanical grippers that engage the bow string directly, or that engage nock elements mounted on the bow string. Other devices use rope looped about the bow string as the release mechanism with or without a mechanical trigger. In release devices of the latter kind, the looped rope is often subject to a twisting action as the archer draws the bow string due to a cocking or turning action of the archer's wrist. This kind of twist or torque applied to the release rope can result in reduced arrow speed and accuracy.

Conventional triggerless back tension rope releases are disclosed in U.S. Pat. Nos. 5,694,915 and 5,965,884. In release aids of this type, it is simply a slight movement of the archer's arm and/or hand, after the arrow is fully drawn, that causes the release of the rope loop from the rope loop hook on the sear, and the concurrent release of the bow string.

It is known to provide a sensitivity adjustment feature that permits adjustment of a "pawl" member that engages the sear to thereby change the degree of movement of the archer's hand required to release the arrow. Increased sensitivity, however, increases the potential for accidental premature firing and/or the possibility of injury to the archer as is or her arm snaps back toward the face.

BRIEF SUMMARY OF THE INVENTION

This invention relates to a triggerless back tension rope release that provides additional freedom of movement during draw by incorporating a two-link release head assembly, each link (a forward link and an intermediate link) freely pivotable about respective pivots relative to each other and to the release handle. The sear, formed with a rope loop hook, is pivotably mounted on the forward link while the pawl is adjustably fixed for movement with the intermediate link. This arrangement allows the archer to draw the bow, with the handle portion of the release assuming various positions and angles throughout the draw cycle, relative to the release head assembly but without affecting the relationship between the pawl and the sear. A locking mechanism is provided that includes mutually perpendicular drive and locking rods that can be actuated through a lever in the handle portion to lock the intermediate link of the release head in any desired position, but leaving the forward link that supports the sear free to swivel relative to its respective pivot axis, but with its arcuate range limited by the position of the intermediate link. In this locked position, the handle, intermediate link and pawl will move together relative to the sear. The arrow can then be released by the conventional movement or flexing of the hand and/or wrist that causes the pawl to move to a position that releases the sear for movement that concurrently causes the rope loop to disengage from the sear hook and the arrow to fire, under the influence of tension in the bow string.

The above described release head assembly and locking mechanism allows the archer to find the optimum draw position before locking the intermediate link, eliminating or at least significantly reducing any potential premature firing of the arrow.

It is another feature of the invention to fix the rope loop ends at a location on the forward link of the release head assembly that is closely adjacent and forward of the pivot pin of the sear, and more particularly, closely adjacent the rope loop hook on the sear. This arrangement insures that the release rope travels from its connection holes in the forward link in a straight line around the bow string and back to the sear hook, where the distance between the release rope lengths at the bow string is equal to or greater than the distance between the release rope lengths at the rope connection holes in the sear and the rope loop hook on the sear. In other words, the distance between the rope release lengths at the sear is substantially equal to or less than the diameter of the bow string. This insures that the bow string is maintained accurately in the exact same position of the release rope "cradle, " not allowing the bow string to slide or move to a varying positions, thereby maintaining a consistent amount of back tension travel to release the shot.

Thus, in accordance with one aspect, the invention relates to a triggerless back tension for use with a bow string, the release comprising a handle portion including at least two finger grooves with a post extending substantially perpendicularly away from the handle portion; a two-link release head assembly secured to a free end of the post remote from the handle portion, the two-link release head including an intermediate link pivotably mounted on the post and a forward link pivotably mounted to the intermediate link; a rope loop having two free ends secured to the forward link; and a sear pivotably secured to the forward link, the sear having a hook adapted to receive the rope loop.

In another aspect, the invention relates to a triggerless back tension release for use with a bow string, the release comprising a handle portion including at least two finger grips with a post extending substantially perpendicularly away from the handle portion; a release head assembly secured to a free end of the post, remote from the handle portion; a sear pivotably secured to the release head assembly for. rotation about a pivot axis, the sear having a hook at one end thereof; and a rope loop having two free ends secured to the release head at a location closely adjacent the hook and forward of the pivot axis, such that, when the rope loop is wrapped about a bow string and slipped over the hook a gap between doubled-back strands of the rope between the bow string and the release head remains substantially constant or increases in a direction toward said bow string.

In still another aspect, the invention relates to a triggerless back tension for use with a bow string, the release comprising a handle portion including at least two finger grooves wish a post extending substantially perpendicularly away from the handle portion; a two-link release head assembly secured to a free end of the post remote from the handle portion, the two-link release head including an intermediate link pivotably mounted on the post and a forward link pivotably mounted to the intermediate link; a rope loop having two free ends secured to the forward link; a sear pivotably secured to the forward link, the sear having a hook adapted to receive the rope loop; and means for selectively locking the intermediate link relative to the post.

DETAILED DESCRIPTION OF THE INVENTION

Figure 1:
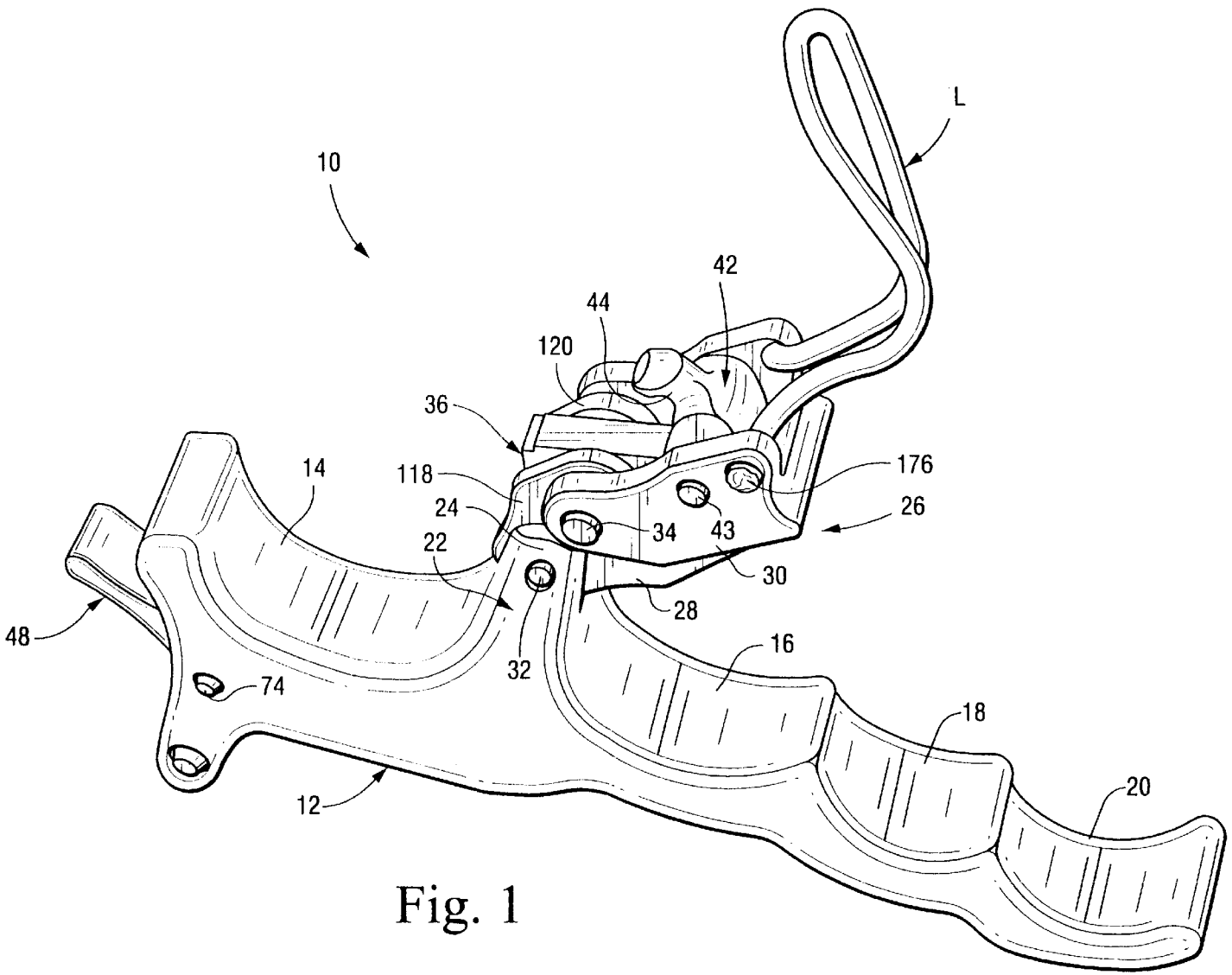
FIG. 1 is a perspective view of the release in accordance with an exemplary embodiment of the invention.

With reference initially to FIGS. 1–4, the release 10 generally includes a handle portion 12 formed with finger grooves 14, 16, 18 and 20 for four-fingered engagement. The number of grooves may be varied as desired, however, depending on personal preference. For example, the release could also have two or three finger grooves. A post 22 extends generally perpendicularly away from the handle portion 12, between the first and second finger grooves 14 and 16, terminating at a fork including a pair of substantially identical laterally spaced bosses 23, 24.

Figure 23:
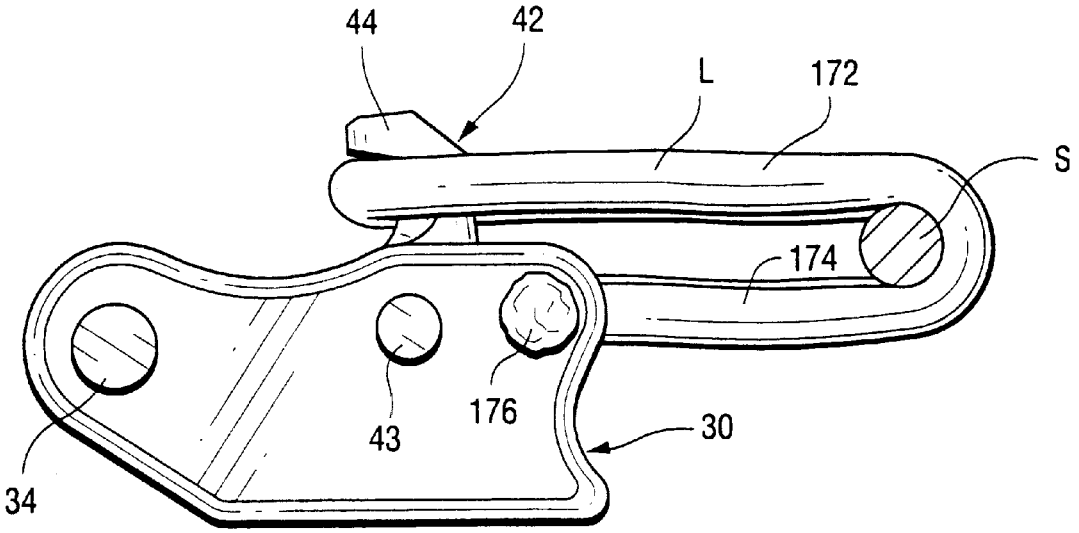
FIG. 23 is a side elevation of the forward link and sear components, with a rope loop wrapped about a bow string and secured to a rope loop hook on the sear.

A release head assembly 26 includes intermediate and forward release links 28 and 30, respectively. The intermediate link or first head component 28 is pivotally mounted to the post 22 via pin 32, while the forward release link or second head component 30 is pivotally mounted to the intermediate release link 28 via pin 34. A pawl 36 (FIGS. 1, 3, 16 and 17) in the form of a truncated or generally D-shaped disk, is adjustably fixed to the intermediate link 28, also via pin 34 and a set screw 38 (FIG. 3) threadably received in a bore 40 in the intermediate link. A sear 42 is pivotally secured to the forward release link 30 via pin 43. The sear 42 has a forward rope loop hook 44 for receiving a rope loop L, and a rearward edge 46 (FIGS. 3 and 4) that cooperates with the pawl 36 as explained further below. It will be appreciated that the loop L is adapted to be wrapped about a bow string S, with the end of the loop L slipped over the hook 44, as illustrated in FIG. 23.

Handle portion 12 supports a locking lever 48 adjacent the index finger groove 14 that is adapted for engagement by the user's thumb. The lever 48 is operatively connected to the intermediate release link 28 via cooperating drive and locking rods as described below. A more detailed description of all of the various component parts of the release follows.

Figure 3:
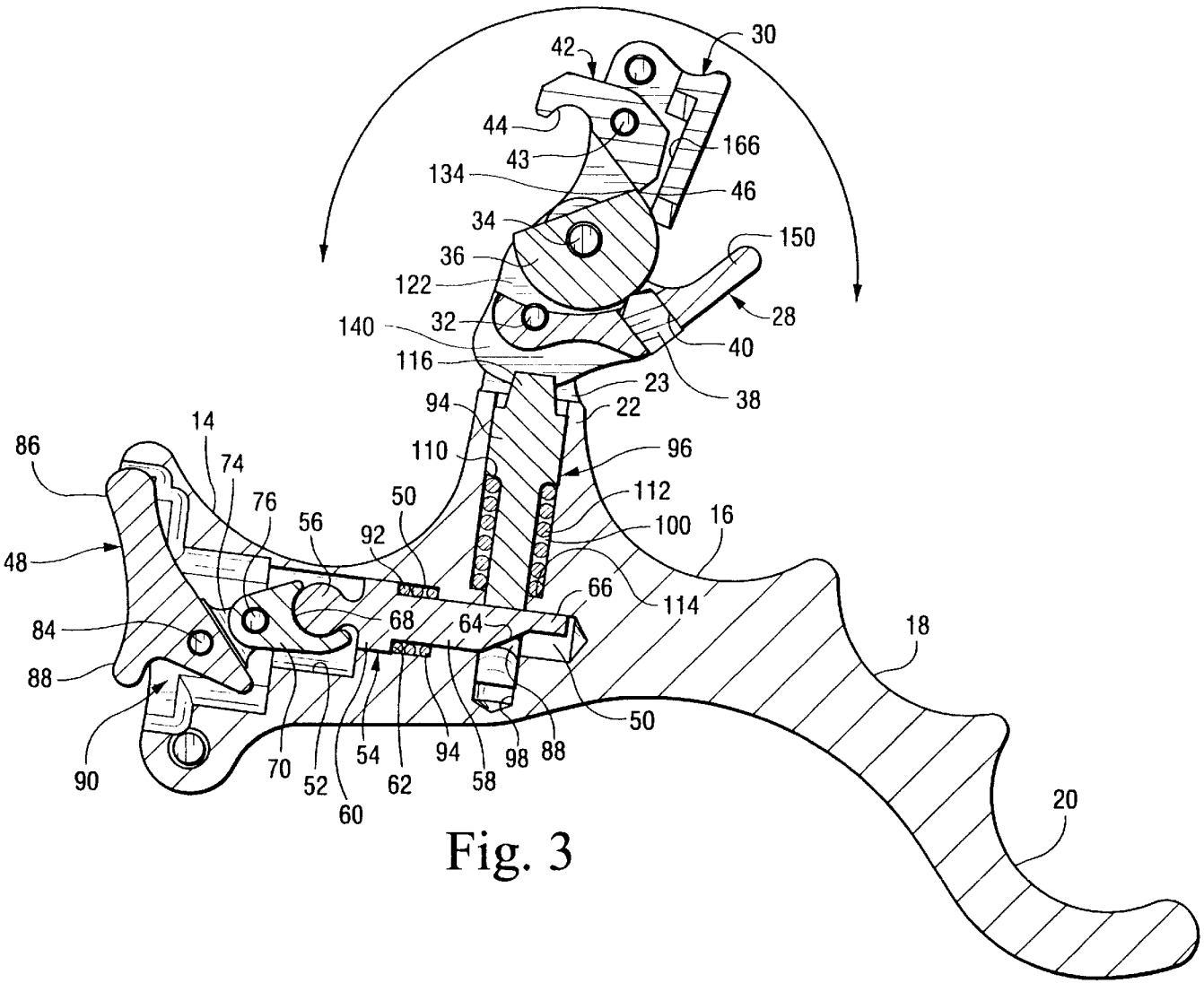
FIG. 3 is a cross section through the release shown in FIGS. 1 and 2, but with intermediate and forward links of the release head assembly rotated relative to one another, and with a locking mechanism in an unlocked position.
Figure 4:
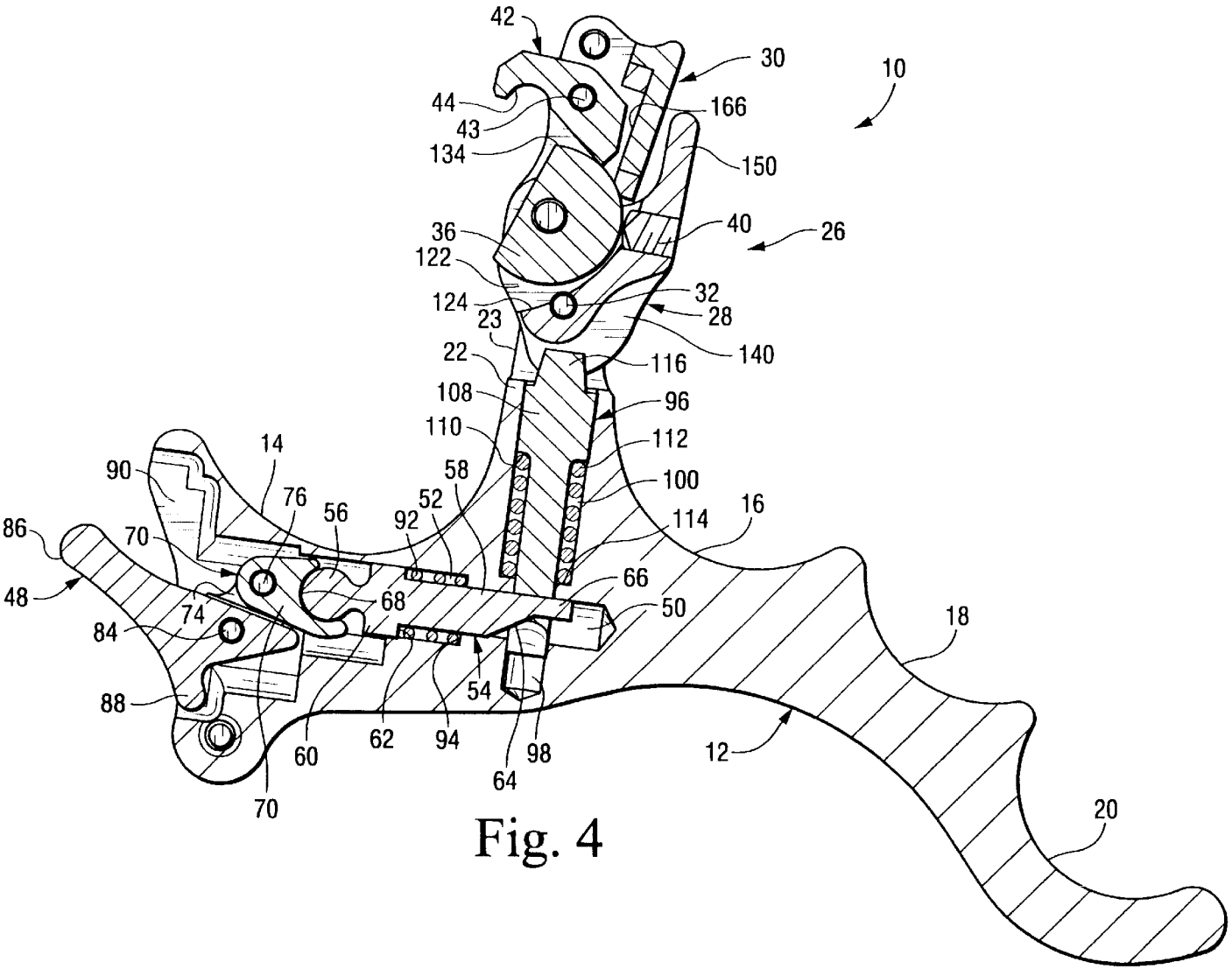
FIG. 4 is a cross section similar to FIG. 3 but illustrating the forward and intermediate links of the release head assembly with the intermediate link rotated relative to the forward link of the release head assembly, and with the locking mechanism in a locked position.
Figure 8:
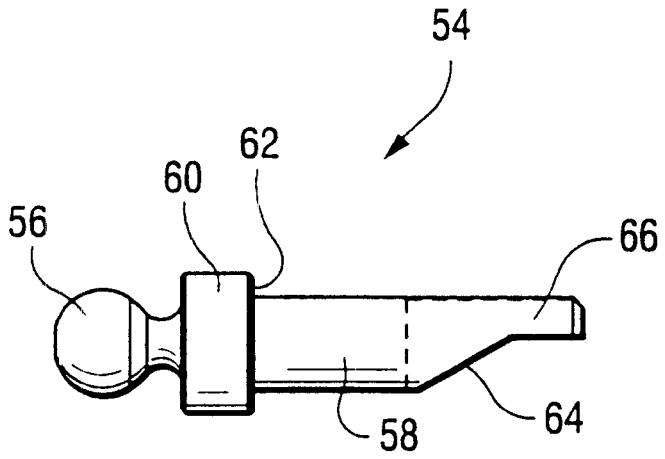
FIG. 8 is a side elevation of a drive rod incorporated into the release shown in FIGS. 1–4.
Figure 9:
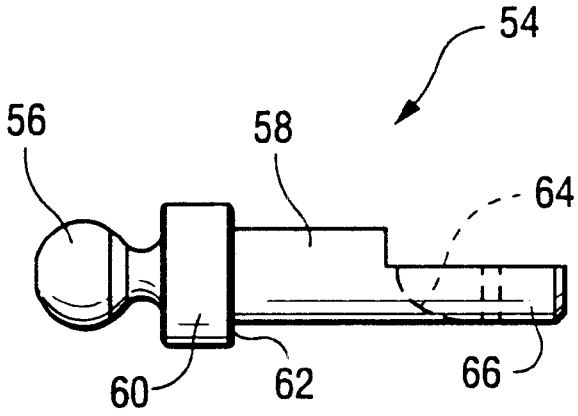
FIG. 9 is a top plan view of the drive rod shown in FIG. 8.
Figure 10:
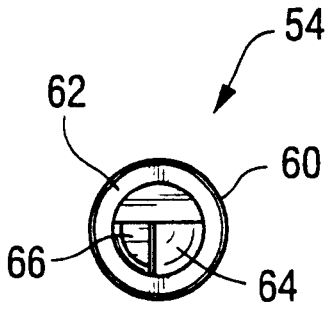
FIG. 10 is a right end elevation of the drive rod shown in FIG. 9.
Figure 11:
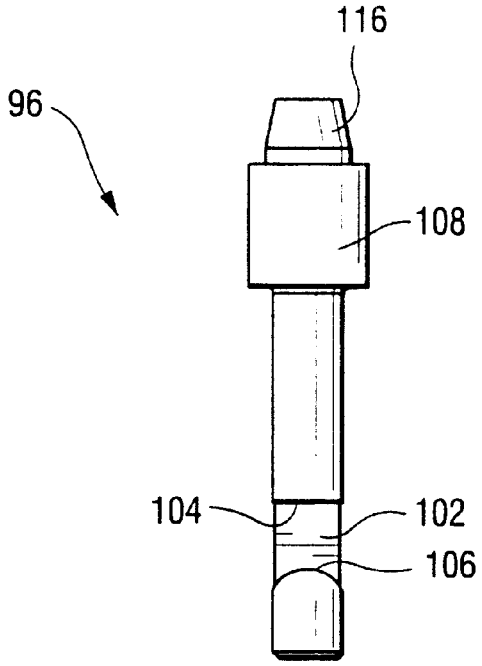
FIG. 11 is a side elevation of a locking rod incorporated into the release shown in FIGS. 1–4.
Figure 12:
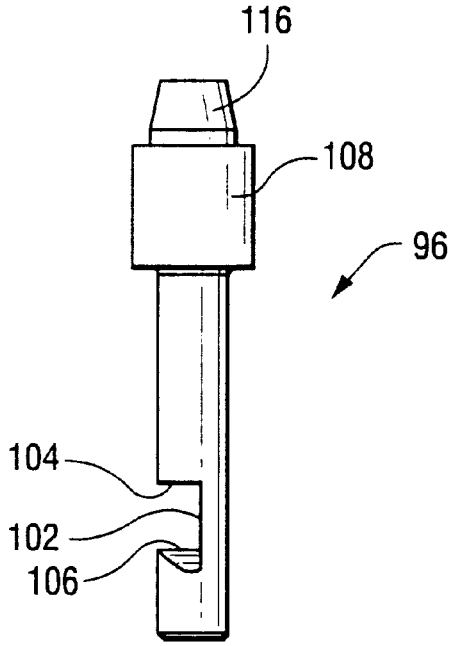
FIG. 12 is an end elevation of the locking rod shown in FIG. 11.

As best seen in FIGS. 3 and 4, the handle portion 12 (preferably made of aluminum) is machined to provide a blind bore 50, counterbored at 52, and is adapted to receive a drive rod 54. With reference also to FIGS. 8–10, the latter is generally cylindrical in shape, with a spherical or ball-shaped rearward end 56 and a main body portion 58, with an enlarged diameter portion 60 having a forward radial shoulder 62 located between the end 56 and main body portion 58. Adjacent the forward end of the main body portion, a tapered cam surface 64 is formed in a circumferential portion of the drive rod, merging with a forward tip 66. Note that the cam surface 64 and forward tip 66 occupy just over 50% of the cross sectional area of the drive rod main body portion 58 as apparent from FIGS. 8–10.

Figure 5:
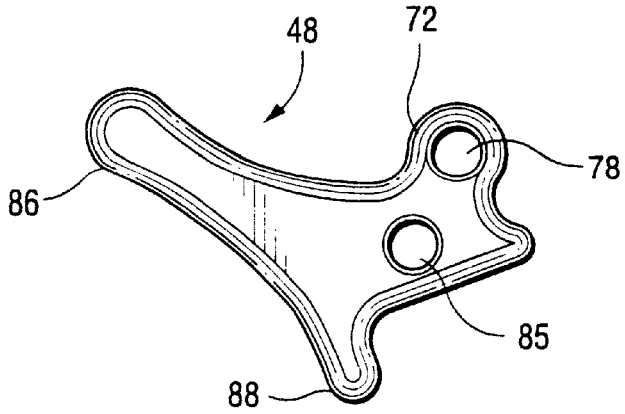
FIG. 5 is a side elevation of a locking lever incorporated into the release shown in FIGS. 1–4.
Figure 6:
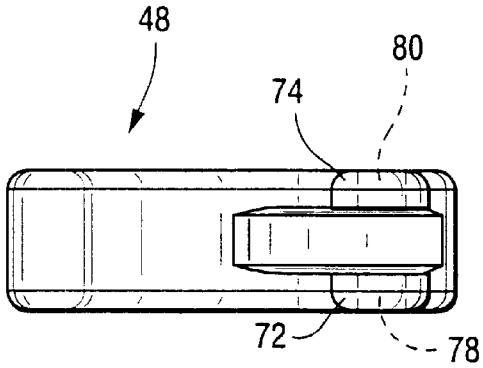
FIG. 6 is a top plan view of the lever illustrated in FIG. 5.
Figure 7:
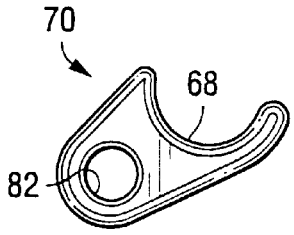
FIG. 7 is a side elevation of a toggle link incorporated into the release shown in FIGS. 1–4.

Referring to FIGS. 3 and 4 but with additional reference to FIGS. 5–7, the spherical or ball-shaped rearward end 56 of the drive rod 54 is received within a cradle portion 68 of a toggle link 70. The latter is pivotally secured between a pair of raised bosses 72, 74 on the lever 48 via pin 76 that is press fit within aligned holes 78, 80 in the bosses 72, 74 of lever 48, passing through aligned hole 82 in the link 70. It will be appreciated that the toggle link 70 is pivotable about the pin 76. The lever 48 is, in turn, secured to the handle portion 12 via pin 84 that passes through hole 85 in lever 48 such that the lever is pivotable about the pin. The lever 48 is formed with a pair of opposite user engageable ends 86, 88 and is adapted to seat in an asymmetrically shaped recess 90 machined into the end of the handle portion, recess 90 opening to the counterbore 52. A coil spring 92 located between shoulder 94 of counterbore 52 and the forward shoulder 62 of the drive rod 54 to bias the drive rod to the left (as viewed in FIGS. 3 and 4).

In the position shown in FIG. 4, the lever 48 has been pressed at 88 to cause the lever to pivot in a counterclockwise direction about the pin 84, causing the toggle link 70 and drive rod 54 to be drawn to the left as viewed in FIGS. 3 and 4 by the lever 48, with drive rod 54 following under the influence of spring 92. Note in this position that pin 76 is substantially centered on the longitudinal axis of the drive rod 54.

A locking rod 96 is slidably mounted in a bore 98, counterbored at 100 and extending primarily within the post 22, but perpendicularly intersecting the bore 50. The locking rod 96 is formed near its lower end (as viewed in FIGS. 3, 4, 11 and 12), with a cut-out portion 102 to one side of the rod, as defined by an upper flat surface 104 and a lower radiused cam surface 106. The surface 106 is engageable by tapered cam surface 64 of the drive rod 54.

The locking rod 96 is also formed with an enlarged diameter portion 108 (as defined in part by shoulder 110) that slides in the counterbore 100. A coil spring 112 is located between shoulder 110 and shoulder 114 of the counterbore 100, thus biasing the locking rod 96 in a direction toward the release head assembly 26. The forward end of the locking rod is formed as a solid truncated cone 116 that serves as the locking surface as described further below.

Figure 13:
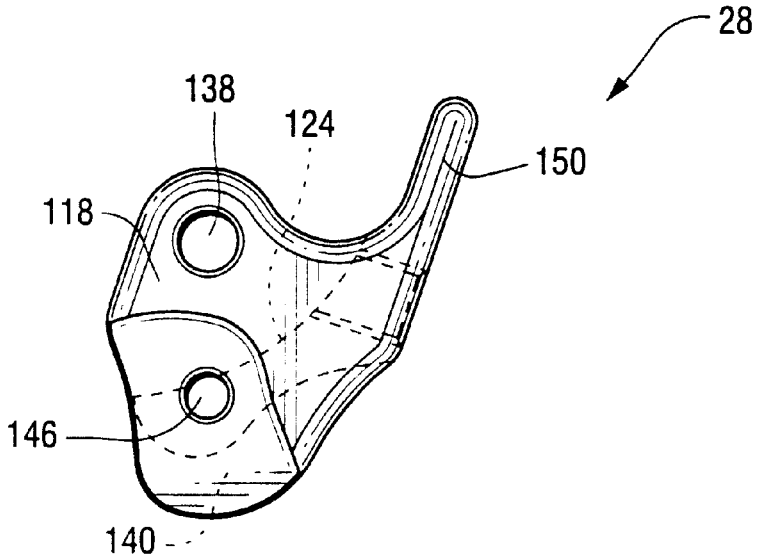
FIG. 13 is a side elevation of an intermediate link incorporated into the release shown in FIGS. 1–4.
Figure 14:
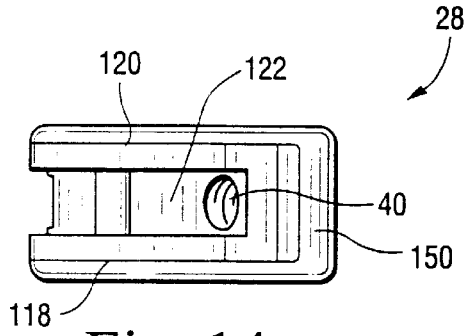
FIG. 14 is a top plan view of the intermediate link shown in FIG. 13.

As noted above, the intermediate link 28 of the release head assembly 26 is pivotally mounted on the remote end of the post 22, in a space between laterally spaced bosses 23, 24 via pin 32. The intermediate link 28 (also shown in FIGS. 13–15) includes a pair of flanges 118, 120 that establish an upper groove or recess 122 therebetween, the base 124 of the groove being curved as best seen in FIGS. 1, 4 and 13. The upper groove or recess 122 receives the D-shaped pawl 36, and the threaded bore 40 opens into the recess 122 and receives the set screw 38. Thus, pawl 36 may be adjusted rotationally about pin 34 and fixed in place via set screw 38 when it is in the desired position vis-a-vis the sear edge 46. In this regard, the pawl 36 includes a radiused surface 128 and a chordal, straight surface 130 that define edges 132, 134. A smooth bore hole 136 in the pawl is alignable with holes (one shown at 138 in FIG. 13) in the flanges 118, 120 for receiving pin 34 as described further below.

Figure 15:
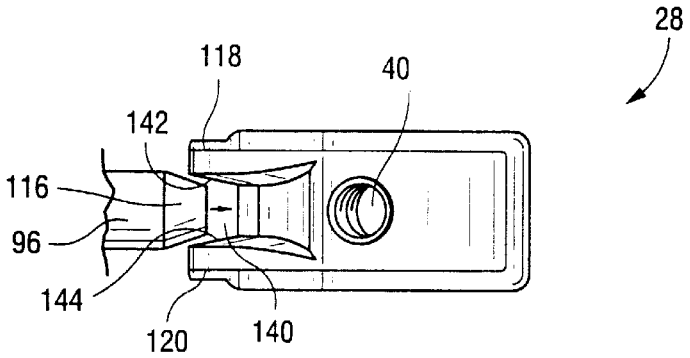
FIG. 15 is a partial assembly, illustrating the manner in which the locking rod engages the intermediate link.
Figure 16:
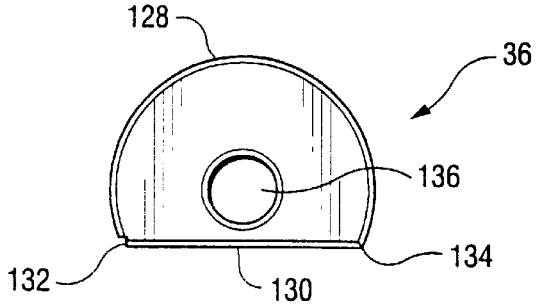
FIG. 16 is a side elevation of a pawl component incorporated into the assembly shown in FIGS. 1–4.
Figure 17:
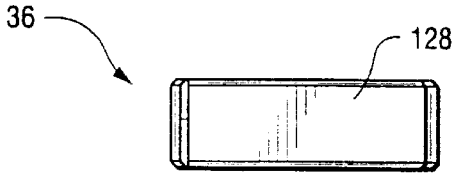
FIG. 17 is a top plan view of the pawl shown in FIG. 16.
Figure 18:
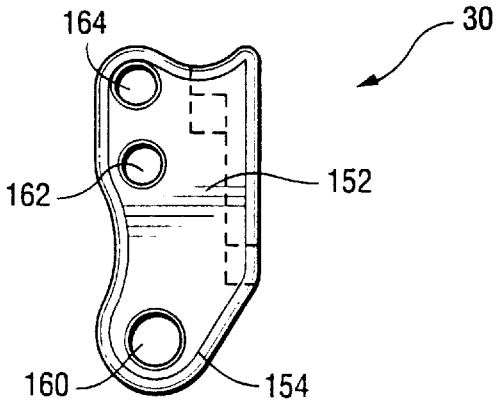
FIG. 18 is a side elevation of a forward link of the release head assembly incorporated into the assembly shown in FIGS. 1–4.
Figure 19:
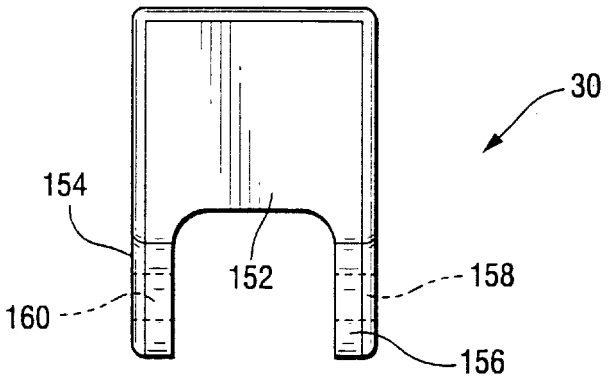
FIG. 19 is an end elevation of the forward link shown in FIG. 18.
Figure 20:
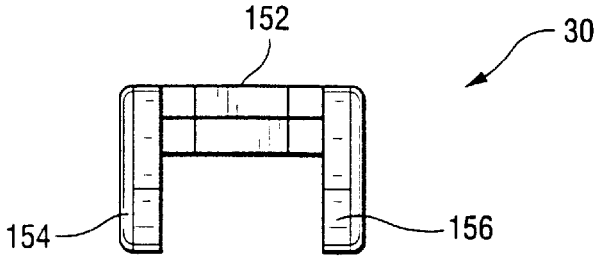
FIG. 20 is a front elevation view of the forward link shown in FIG. 19.

The flanges 118, 120 also define a lower recess 140 that is defined in part by opposed, tapered surfaces 142, 144 (FIG. 15) that are centered above the locking rod 96. With particular reference to FIG. 15, it can be seen that axial movement of rod 96 will cause the truncated, cone-shaped end 116 of the rod to engage or disengage surfaces 142, 144 depending on the direction of movement of the rod 96. More specifically, the truncated cone 116 of the locking rod 96 will engage the surfaces 142, 144 when the locking rod 96 is raised (as viewed in FIGS. 3 and 4), and conversely, will disengage when the locking rod is lowered. When engaged, the intermediate link 28 is fixed relative to the post 22 and handle portion 12 to prevent unwanted pivoting motion of the intermediate link 28 during final draw and shoot movements of the archer's hand and/or wrist.

The intermediate link 28 also includes aligned holes, one shown at 146, that align with holes in the post bosses 23, 24 for receiving the pin 32. Note that link 28 fits between the bosses 23, 24. Pin 32 is press fit within aligned holes in the bosses 23, 24, but permits rotation of link 28 about the pin. One end of the link 28 is provided with an upstanding tab 150 that projects generally toward the forward link 30, and that serves as a movement limiter for the forward link.

Figure 2:
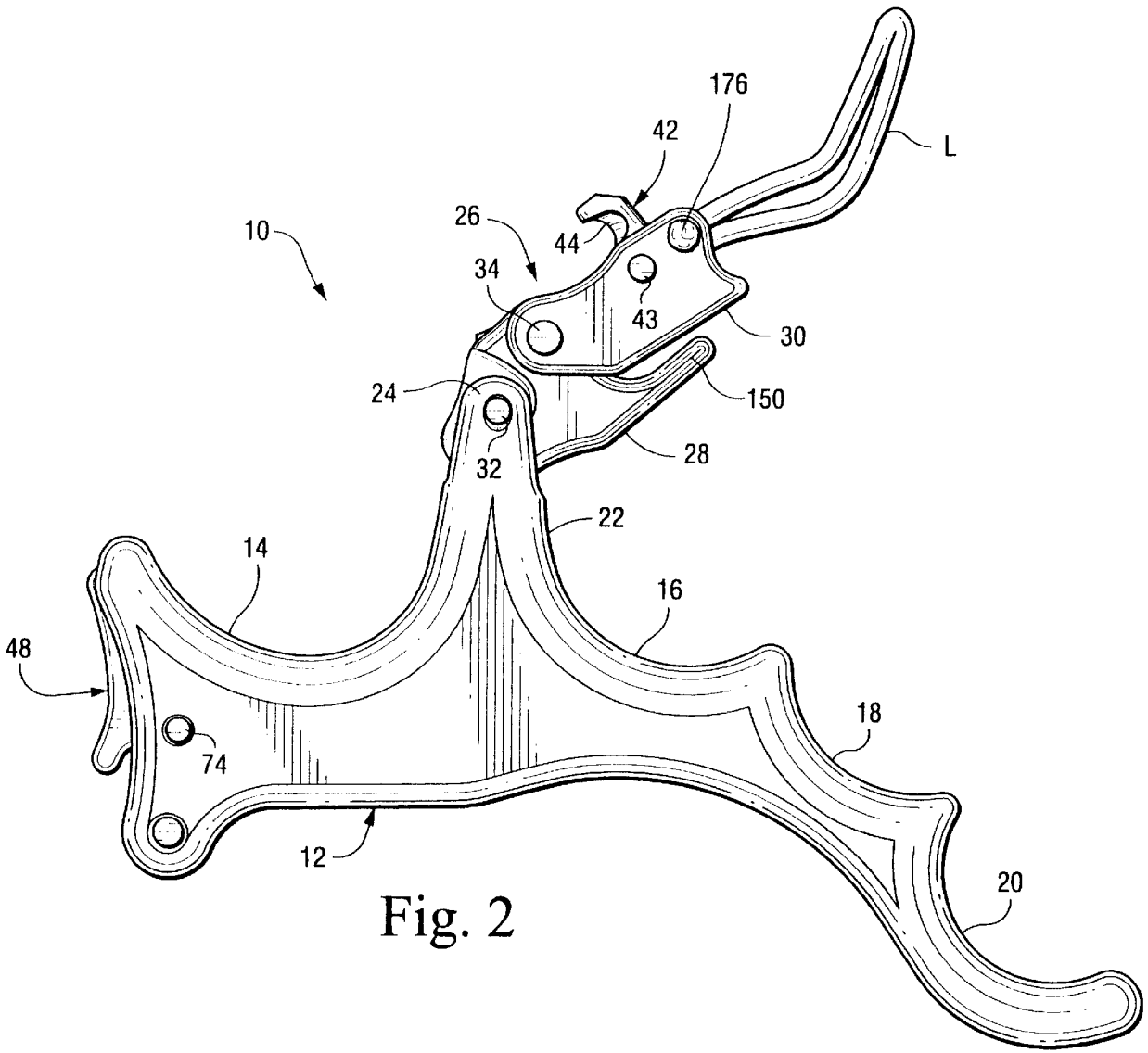
FIG. 2 is a side elevation of the release shown in FIG. 1.

The forward link 30 of the release head assembly includes a base portion 152 with laterally spaced sides 154, 156. At the end of the forward link 30 closest the intermediate link 28, aligned holes 158, 160 are provided in the respective sides 154, 156. These holes align with a second set of aligned holes in the intermediate link 28 (see hole 138 in FIG. 13), permitting press fit of pin 34 to pivotally secure the forward link to the intermediate link 28. Pin 34 is press fit into the holes 158, 160 but sufficient clearance is provided in the aligned holes in the intermediate link 28 and pawl 36 so that the forward link 30 and pin 34 rotate together relative to the intermediate link 28 and pawl 36. Adjacent the remote end of the forward link 30, aligned holes, one shown at 162, are provided for receiving in press fit relationship the pin 43 that also passes through the sear 42 to pivotally secure the latter to the forward link 30. Closely adjacent the holes 162 are another pair of holes, one shown at 164, that retain free ends of the loop L. The latter may be inserted through the holes and then melted (or heat riveted) to secure the loop ends to the forward link 30 as best seen in FIGS. 1, 2 and 23.

Figure 21:
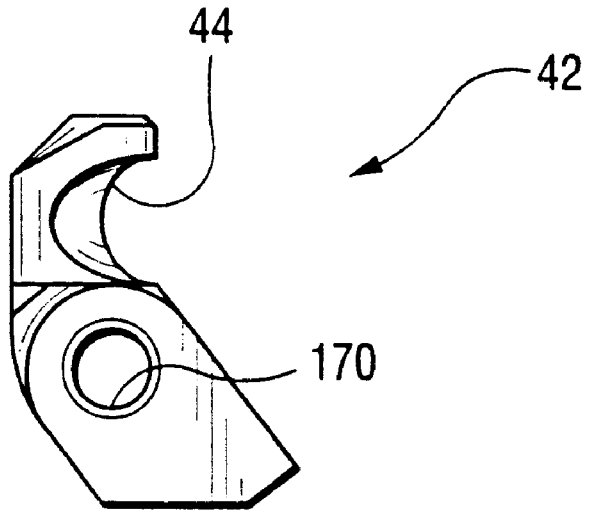
FIG. 21 is a side elevation of a sear component incorporated into the release shown in FIGS. 1–4.
Figure 22:
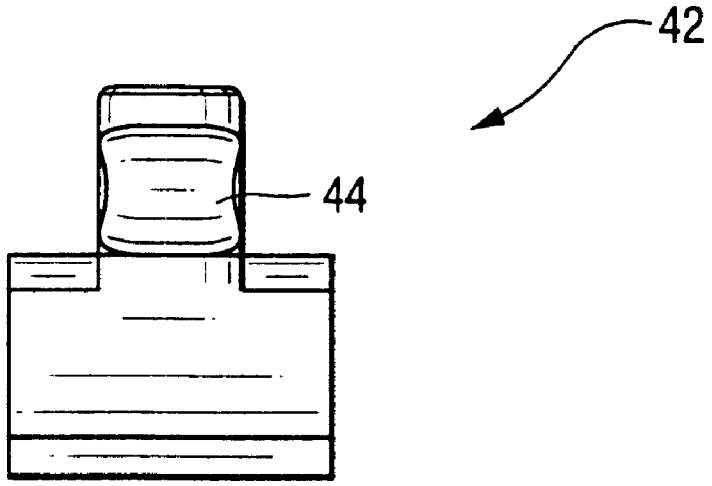
FIG. 22 is a top plan view of the sear illustrated in FIG. 21.

Sear 42 is best seen in FIGS. 21 and 22 and is formed with a hole 170 that aligns with holes 162 so that pin 43 can be press fit into the forward link 30 to secure the sear to the forward link, but free to pivot about the pin 43.

Given the above construction, it is apparent that the sear 42 is pivotable relative to the forward link 30, but with limits imposed by the pawl 36 and surface 166 of the forward link 30. The forward link 30 is also pivotable relative to the intermediate link 28 via pin 34, within limits set by tab 150 and pawl 36. The intermediate link 28 is pivotable via pin 32 relative to the post 22 within limits set by the fork formed by post bosses 23, 24. The operation of the release 10 will now be described.

With reference to FIG. 3, when the end 86 of lever 48 is depressed, the lever 48 will pivot about pin 84 in a clockwise direction (as viewed in FIG. 3), pushing the toggle link 70 to the right, with the cradle 68 acting on the ball 56 of the drive rod 54, causing the latter to move to the right as well. As the drive rod cam surface 64 rides over the cam surface 106 on the locking rod 96, the latter will be pulled downwardly, against the bias of spring 112, and thus causing the forward truncated cone-shaped end 116 of the locking rod 96 to disengage from the surfaces 142, 144 on the intermediate link 28, thus freeing the latter for pivoting movement about the pin 32.

As the lever 48 reaches the limit of its travel, pivot pin 76 that mounts the toggle link 70 to the lever, swings just beyond the longitudinal axis of the drive rod 54, against the bias of spring 92. The shape of the cradle 68 enables the drive connection with the ball 56 to be maintained as the rearward end of the toggle moves to its "over-the-center" position, thereby maintaining the drive rod 54 in its extended position, holding the locking rod 96 in an unlocked or retracted position.

When the opposite end 88 of the lever 48 is depressed, the toggle link 70 swings back to a substantially centered position, allowing spring 92 to push the drive rod 54 rearwardly (to the left in FIGS. 3 and 4) such that cam surfaces 64 and 106 disengage sufficiently to allow spring 90 to push the locking rod 96 and its tapered end 116 forward into engagement with the surfaces 142, 144 on the intermediate link 28, thereby locking the intermediate link 28 relative to the post 22.

To use the release, end 86 of the lever 48 is initially depressed to free up the intermediate link 28 as described above, such that both the intermediate and forward links 28, 30 of the release head assembly 26 are free to pivot or swivel throughout their respective ranges of movement, relative to the post 22 (and hence handle portion 12) and relative to each other. With the sear edge 46 located behind the pawl edge 134, i.e., edge 46 is to the right of edge 134 as viewed in FIG. 3. The rope L is then looped about the bow string (see FIG. 23) and slipped over the hook portion 44 of the sear 42. The sear 42, pivotally supported on the forward link 30, can be properly located with edge 46 behind the pawl edge 134 due to the ability of the forward link to rot at e relative to the intermediate link 28, and of course, the ability of the sear 42 to rotate relative to the forward link 30. In this position, the sear is prevented from moving past the pawl, absent movement of the pawl relative to the sear.

As the archer draws the release toward his chest and face, any lateral movement of the hand and subsequent rotation of the handle portion 12 will not translate to the intermediate link 28 or to the pawl 36 which is fixed thereto, because of the freedom of the release handle portion 12 to rotate relative to the release head assembly 26, and of the intermediate and forward links 28, 30 to rotate relative to each other.

When the full draw position is reached, or just prior, and with the optimum draw position having been achieved, the archer will depress the end 88 of lever 48, actuating the locking rod as explained above, to lock the intermediate link 28 in the desired position. Now, the intermediate link 28 and pawl 36 are fixed relative to the release post 22 and handle portion 12, but the forward link 30 (and sear 42) is still free to rotate about pin 34, but limited by the position of tab 150. The archer can now fire the arrow by a slight rotation of the handle and intermediate link 28, causing the pawl edge 134 to rotate past the sear edge 46 in a counterclockwise direction as viewed in FIGS. 3 and 4, thus releasing the sear 42 and hook 44 for rotation in a clockwise position that, in turn, releases the rope loop L and the bow string S under the influence of tension in the bow string.

With specific reference to FIG. 23, it is significant that as the bow string is being drawn to a fully tensioned position, the adjacent and doubled back strands 172, 174 of the loop L are maintained in a closely and substantially parallel relationship. In fact, the distance between the strands 172, 174 remains substantially equal, or even increases slightly in the direction of the bow string. This arrangement is achieved by locating hook 44 adjacent pin 43 and rope loop ends 176 adjacent and forward of pin 43. This relationship insures that the bow string remains substantially fixed in the cradle or loop of the rope L throughout the draw, insuring consistent release points and accuracy of the shots.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A triggerless back tension release for use with a bow string, the release comprising:

a handle portion including at least two finger grooves with a post extending substantially perpendicularly away from said handle portion;

a two-link release head assembly secured to a free end of said post remote from said handle portion, said two-link release head including an intermediate link pivotably mounted on said post and a forward link pivotably mounted to said intermediate link;

a rope loop having two free ends secured to said forward link; and a sear pivotably secured to said forward link, said sear having a hook adapted to receive said rope loop.

2. The release of claim 1 and further comprising a pawl fixed to said intermediate link and arranged to engage an edge of said sear and to release said sear upon relative movement between said pawl and said sear.

3. The release of claim 2 wherein said pawl comprises a substantially D-shaped disk having an arcuate edge that is engaged by said rearward edge of said sear, said pawl mounted for rotation on said intermediate link to thereby permit adjustable movement of said arcuate edge relative to said rearward edge of said sear; and means for locking said pawl in a desired position relative to said rearward edge of said sear.

4. The release of claim 1 and further comprising a lever in said handle portion and a locking rod slidably received in said post and selectively engageable with said intermediate link, said lever operatively connected to said locking rod to move said locking rod toward or away from said intermediate link.

5. The release of claim 4 wherein a drive rod is slidably received in said handle portion and connected to said lever by a toggle link pivotally connected to said lever; a forward end of said drive rod and a rearward end of said locking rod having cooperating cam surfaces such that movement of said drive rod toward said locking rod causes said locking rod to move away from said intermediate link.

6. The release of claim 5 wherein said drive rod is formed with a substantially ball-shaped rearward end that is nested within a cradle portion of said toggle link.

7. The release of claim 6 wherein a pivot axis of said toggle link is moveable from a position substantially aligned with a longitudinal axis of the drive rod to a position offset from said longitudinal axis as said drive rod moves toward said locking rod.

8. The release of claim 7 wherein said lever includes press surfaces at opposite ends thereof such that pressing one end of said lever causes said drive rod to move toward said locking rod and to move said locking rod away from said intermediate link, and pressing the other end of said lever causes said drive rod to move away from said locking rod and permitting said first spring to move said locking rod into engagement with said intermediate link.

9. The release of claim 4 wherein said locking rod is engaged by a first spring arranged to bias said locking rod toward said intermediate link.

10. The release of claim 9 wherein said drive rod is engaged by a second spring arranged to bias said drive rod away from said locking rod.

11. The release of claim 4 wherein said intermediate link is free to rotate about a first pivot pin in said post and wherein said locking rod has a tapered end movable into engagement with said intermediate link upon movement of said lever to lock said intermediate link relative to said handle portion in any position within a range of movement of said intermediate link.

12. The release of claim 11 wherein said forward link is rotatable about a second pivot pin fixed to said intermediate link whether said intermediate link is locked or unlocked.

13. The release of claim 12 wherein said intermediate link includes a tab positioned to limit pivoting movement of said forward link when said intermediate link is locked.

14. The release of claim 3 wherein said handle portion is formed with four finger grooves, said post located between first and second of said finger grooves and wherein said lever is located in an end of said handle portion adjacent said first of said finger grooves.

15. A triggerless back tension release for use with a bow string, the release comprising:

a handle portion including at least two finger grips with a post extending substantially perpendicularly away from said handle portion;

a release head assembly secured to a free end of said post, remote from said handle portion;

a sear pivotably secured to said release head assembly for rotation about a pivot axis, said sear having a hook at one end thereof; a rope loop having two free ends secured to said release head at a location closely adjacent said hook and forward of said pivot axis, such that, when said rope loop is wrapped about a bow string and slipped over said hook, a gap between doubled-back strands of said rope between said bow string and said release head remains substantially constant or increases in a direction toward said bow string.

16. The release of claim 15 wherein said sear has a release edge at an opposite end thereof, said pivot axis lying between said hook and said release edge.

17. The release of claim 15 wherein said release head comprises a two-link release head assembly including an intermediate link pivotably mounted on said post and a forward link pivotably mounted on said intermediate link.

18. The release of claim 17 wherein said sear is pivotably mounted on said forward link.

19. The release of claim 18 and further comprising a pawl fixed to said intermediate link and arranged to engage an edge of said sear and to release said sear upon relative movement between said pawl and said sear.

20. A triggerless back tension release for use with a bow string, the release comprising:

a handle portion including at least two finger grooves with a post extending substantially perpendicularly away from said handle portion;

a two-link release head assembly secured to a free end of said post remote from said handle portion, said two-link release head including an intermediate link pivotably mounted on said post and a forward link pivotably mounted to said intermediate link;

a rope loop having two free ends secured to said forward link;

a sear pivotably secured to said forward link, said sear having a hook adapted to receive said rope loop; and means for selectively locking said intermediate link relative to said post.

21. The release of claim 20 and further comprising a pawl fixed to said intermediate link and arranged to engage an edge of said sear and to release said sear upon relative movement between said pawl and said sear.

22. The release of claim 21 wherein said pawl comprises a substantially D-shaped disk having an arcuate edge that is engaged by said rearward edge of said sear, said pawl mounted for rotation on said intermediate link to thereby permit adjustable movement of said arcuate edge relative to said rearward edge of said sear; and means for locking said pawl in a desired position relative to said rearward edge of said sear.

23. The release of claim 21 wherein said two free ends are secured to said forward link at a location closely adjacent said hook and forward of a pivot axis of said sear, such that, when said rope loop is wrapped about a bow string and slipped over said hook, a gap between doubled-back strands of said rope between said bow string and said release head remains substantially constant or increases in a direction toward said bow string.

24. The release of claim 23 wherein said sear has a release edge at an opposite end thereof, said pivot axis lying between said hook and said release edge.

25. A triggerless back tension release for use with a bowstring comprising:

a handle including a member extending substantially perpendicularly away from said handle;

a release head assembly including first head component secured to said member for rotation about a first axis through a defined first range of motion; a second head component secured to said first head component for rotation about a second axis parallel to said first axis through a defined second range of motion;

a sear adapted for engagement with a rope loop pivotally secured to said second head component for rotation about a third axis parallel to said first axis and said second axis;

and a locking lever operatively connected to said first head component for locking said first head component relative to said member at any location in said defined first range of motion.

26. The triggerless back tension release of claim 25 and further comprising a pawl adjustably fixed to said first head component and arranged to be engaged by an edge of said sear.

27. The triggerless back tension release of claim 26 wherein said locking lever is mounted in said handle.

28. The triggerless back tension release of claim 27 wherein a locking rod is slidably received in said member and selectively engageable with said first head component, said locking lever operatively connected to said locking rod for moving said locking rod toward or away from said first head component.

29. The triggerless back tension release of claim 28 wherein said rope loop has two free ends attached to said second head component, forming a loop adapted for engagement with a hook portion formed on one end of said sear.

30. A triggerless back tension release for use with a bowstring comprising:

a handle including a member extending substantially perpendicularly away from said handle;

a release head assembly including first head component secured to said member for rotation about a first axis through a defined first range of motion; a second head component secured to said first head component for rotation about a second axis parallel to said first axis through a defined second range of motion;

a sear adapted for engagement with a rope loop pivotally secured to said second head component for rotation about a third axis parallel to said first axis and said second axis;

wherein said second head component is rotatable about both said first axis and said second axis.

31. The triggerless back tension release of claim 30 and further comprising a locking lever operatively connected through said handle to said first head component for locking the first head component relative to said member at any location along said first range of motion.

32. A triggerless back tension release for use with a bowstring comprising:

a handle including a member extending substantially perpendicularly away from said handle;

a release head assembly including first head component secured to said member for rotation about a first axis through a range of motion;

a sear adapted for engagement with a rope loop pivotally secured to said release head assembly; and a locking lever operatively connected through said handle to said first head component for locking the first head component relative to said member at any location along said range of motion.

* * * * *